US008333174B2

(12) United States Patent
Carlsson et al.

(10) Patent No.: US 8,333,174 B2
(45) Date of Patent: Dec. 18, 2012

(54) IDLE SPEED CONTROL FOR A HANDHELD POWER TOOL

(75) Inventors: Bo Carlsson, Alingsås (SE); Mikael Larsson, Jönköping (SE)

(73) Assignee: Husqvarna AB, Huskvarna (SE)

( * ) Notice: Subject to any disclaimer, the term of this patent is extended or adjusted under 35 U.S.C. 154(b) by 392 days.

(21) Appl. No.: 12/679,276

(22) PCT Filed: Sep. 21, 2007

(86) PCT No.: PCT/SE2007/000825

§ 371 (c)(1), (2), (4) Date: May 19, 2010

(87) PCT Pub. No.: WO2009/038503

PCT Pub. Date: Mar. 26, 2009

(65) Prior Publication Data

US 2010/0252011 A1 Oct. 7, 2010

(51) Int. Cl.
*F02M 3/00* (2006.01)

(52) U.S. Cl. ..... 123/339.1; 123/339.14; 123/339.2; 701/110

(58) Field of Classification Search ..... 123/339.1, 123/339.12, 339.14, 339.19, 339.2, 339.21, 123/339.27, 349, 350, 352, 353; 701/103, 701/104, 106, 110

See application file for complete search history.

(56) References Cited

U.S. PATENT DOCUMENTS 4,785,780 A * 11/1988 Kawai ..... 123/339.2
5,269,271 A * 12/1993 Kawai et al. ..... 123/339.11
5,313,395 A * 5/1994 Kawai et al. ..... 701/110
5,936,152 A * 8/1999 Nishioka et al. ..... 73/114.25
7,792,623 B2 * 9/2010 Kuwahara et al. ..... 701/54

* cited by examiner

*Primary Examiner* — Thomas Moulis
(74) *Attorney, Agent, or Firm* — Novak Druce + Quigg LLP

(57) ABSTRACT

Method for controlling fuel metering in a carburetor or a low pressure injection system of an internal combustion engine when the engine is operating at idle speed, the method includes the steps of:

a) monitoring the engine speed;

b) determining a first variable (A) based on a first moving average algorithm using the monitored engine speed as input data;

c) determining a second variable (B) based on a second moving average algorithm using the monitored engine speed as input data, where the first moving average algorithm is arranged to react faster to an engine speed change than the second moving average algorithm;

d) comparing the second variable (B) to the first variable (A), where if 1) the second variable (B) is higher than the first variable (A): the fuel metering is set in a first leaner setting, and where if 2) the second variable (B) is lower than the first variable (A): the fuel metering is set in a second richer setting.

16 Claims, 5 Drawing Sheets

Fig. 5

SHUT-OFF SCHEDULE FOR A 32-PERIOD SYSTEM

| FUEL CONTROL SEQUENCE. [$N_S$/PL ] | 16/32 | 15/32 | 14/32 | 13/32 | 12/32 | 11/32 | 10/32 | 9/32 | 8/32 | 7/32 | 6/32 | 5/32 | 4/32 | 3/32 | 2/32 | 1/32 | 0/32 |
|---|---|---|---|---|---|---|---|---|---|---|---|---|---|---|---|---|---|
| FUEL REDUCTION | 50% | 47% | 44% | 41% | 38% | 34% | 31% | 28% | 25% | 22% | 19% | 16% | 13% | 9% | 6% | 3% | 0% |
| FUEL SHUT-OFF POSITIONS | | | | | | | | | | | | | | | | | |
| **FC1** | 1 | 1 | 1 | 1 | 1 | 1 | 1 | 1 | 1 | 1 | 1 | 1 | 1 | 1 | 1 | 1 | |
| **FC2** | 3 | 3 | 3 | 3 | 4 | 4 | 4 | 5 | 5 | 6 | 6 | 7 | 9 | 12 | 17 | | |
| **FC3** | 5 | 5 | 6 | 6 | 6 | 7 | 7 | 8 | 9 | 10 | 12 | 14 | 17 | 22 | | | |
| **FC4** | 7 | 7 | 8 | 8 | 9 | 10 | 11 | 12 | 13 | 15 | 17 | 20 | 25 | | | | |
| **FC5** | 9 | 10 | 10 | 11 | 12 | 13 | 14 | 15 | 17 | 19 | 22 | 27 | | | | | |
| **FC6** | 11 | 12 | 12 | 13 | 14 | 16 | 17 | 19 | 21 | 24 | 28 | | | | | | |
| **FC7** | 13 | 14 | 15 | 16 | 17 | 18 | 20 | 22 | 25 | 28 | | | | | | | |
| **FC8** | 15 | 16 | 17 | 18 | 20 | 21 | 23 | 26 | 29 | | | | | | | | |
| **FC9** | 17 | 18 | 19 | 21 | 22 | 24 | 27 | 29 | | | | | | | | | |
| **FC10** | 19 | 20 | 22 | 23 | 25 | 27 | 30 | | | | | | | | | | |
| **FC11** | 21 | 22 | 24 | 26 | 28 | 30 | | | | | | | | | | | |
| **FC12** | 23 | 24 | 26 | 28 | 30 | | | | | | | | | | | | |
| **FC13** | 25 | 27 | 28 | 31 | | | | | | | | | | | | | |
| **FC14** | 27 | 29 | 31 | | | | | | | | | | | | | | |
| **FC15** | 29 | 31 | | | | | | | | | | | | | | | |
| **FC16** | 31 | | | | | | | | | | | | | | | | |

IDLE SPEED CONTROL FOR A HANDHELD POWER TOOL

TECHNICAL FIELD

The present disclosure relates to an idling speed control method for an engine in which the fuel metering during idling is adjusted so as to find an A/F ratio close to an optimal A/F ratio.

BACKGROUND OF THE INVENTION

In most engines for a power saw, a power cutter, a lawn mover and similar consumer products, the A/F ratio is manually controllable when the engine is idling, e.g. the electronic control system is only active when the engine is at working speed or above. It would therefore be desirable to have a simple, non-expensive but efficient electronic control method, without the need of adjusting the fuel or air supply manually, when the engine is idling.

EP 0 715 686 B1 describes a method of controlling the engine A/F-ratio. Initially, the A/F-ratio is changed briefly. This could be effected for instance by briefly throttling or stopping the fuel metering. In connection with the change, a number of engine revolution times are measured. The revolution times relate to engine rotational speeds chosen in such a manner that at least one revolution of the engine is unaffected by the change, preferably an engine rotational speed that is sufficiently early for the A/F-ratio change not having had time to affect the engine rotational speed. Further at least one forthcoming revolution of the engine is chosen in such a manner that it is affected by the brief A/F-ratio change. In this manner it becomes possible to compute a revolution-time difference caused by an A/F-ratio change. On the basis of this revolution-time difference a change, if needed, of the mixture ratio in the desired direction towards a leaner or richer mixture is made. Thus using this method an optimal mixture can be achieved by testing how the engine reacts to a leaner or richer mixture. However this control is somewhat slow and mainly suitable for controlling the engine at working speeds.

PCT/SE06/000561 describes an idle speed control where the engine is started with a rich fuel setting and where the fuel setting is gradually moved towards a leaner setting until an engine speed interval is reached and if the engine speed comes above the engine speed interval the fuel setting is gradually moved towards a richer setting. It also describes a method for idle speed control using a single engine speed value where the fuel metering is decreased when the engine speed is below the engine speed value and increased when the engine speed is larger than the engine speed value. This method will find a desired engine speed; however the A/F ratio may come far from an optimal A/F ratio.

U.S. Pat. No. 6,769,394 describes a method for controlling the fuel supply to an internal combustion engine. An interval is allocated around a desired parameter value, e.g. the engine speed. When the measured parameter crosses the lower and/or upper threshold from below to above the fuel supply is cut off. And when the measured parameter crosses the upper and/or lower threshold from above to below fuel supply is switched on. The method can be used at idle. This method will fluctuate around a desired engine speed; however the A/F ratio may come far from the optimal A/F ratio.

EP 0 799 377 describes a method characterized primarily in that in the fuel supply system a fuel shut-off is effected during a part of the operating cycle by means of an on/off valve shutting off the entire fuel flow or a part flow, and in that the shut-off is arranged to take place to an essential extent during a part of the operating cycle when the intake passage is closed and consequently the feed of fuel is reduced or has ceased. This means that the amount of fuel supplied can be precision-adjusted by a slight displacement of one or both of the flanks of the on/off valve shut-off curve; this method will be referred to as Pulse Width Modulation (PWM) of the fuel supply. However, EP 0 799 377 also suggest that in particular for crank case scavenged two/four-stroke engines, the shut-offs can be performed every other, every third or possibly every forth engine revolution instead upon each engine revolution, in the case of a four-stroke engine, half as often. Of course the on/off valve could also be set to be open every revolution. In that case a major fuel amount adjustment is made instead, for instance by completely shutting off the fuel supply for a revolution. This can be done since the crank case in crank case scavenged two-stroke engines or crank case scavenged four-stroke engines can hold a considerable amount of fuel and consequently serve as a levelling reservoir, it is therefore not necessary to adjust the fuel supply for each revolution when controlling the fuel supply to the engine, i.e. adjusting the fuel supply in one revolution will affect the subsequent revolutions.

OBJECTS OF THE INVENTION

It is an object of the invention to provide a method for adjusting the fuel metering when the engine is operating at idle speed.

Another object of the invention is to provide a fuel metering during idling which tunes towards an A/F ratio that is close to an optimal A/F ratio and preferably an A/F ratio that is slightly biased towards a rich A/F ratio.

SUMMARY OF THE INVENTION

At least one of the above mentioned objects and/or problems are met by providing a method for controlling the fuel metering in a carburetor or a low pressure injection system of an internal combustion engine when the engine is operating at idle speed. The method comprising the steps of:

a) monitoring the engine speed;

b) determining a first variable based on a first moving average algorithm using the monitored engine speed as input data;

c) determining a second variable based on a second moving average algorithm using the monitored engine speed as input data, where the first moving average algorithm is arranged to react faster to an engine speed change than the second moving average algorithm;

d) comparing the second variable to the first variable, where if 1) the second variable is higher than the first variable: the fuel metering is set in a first leaner setting, and where if 2) the second variable is lower than the first variable: the fuel metering is set in a second richer setting.

Preferably the first moving average algorithm addresses more weight to a lower number of monitored engine speeds when determining the first moving average while when determining the second moving average more weight is given to a higher number of monitored engine speeds, so that the first moving average algorithm is thereby arranged to react faster to an engine speed change than the second moving average algorithm.

It is also preferred that when determining the second variable the outcome from the second moving average algorithm is biased to correspond to a lower averaged engine speed for instance by subtracting the outcome with a positive constant or multiplying with a factor smaller than 1.

According to another example when determining the first variable the outcome from the first moving average algorithm is biased to correspond to an higher averaged engine speed for instance by adding the outcome with a positive constant or multiplying with factor larger than 1.

Further according to an embodiment the first moving average algorithm is based on a first plurality of samples of the monitored engine speed and the second moving average algorithm is based on a second plurality of samples of the monitored engine speed, where the first plurality includes fewer samples than the second plurality. And where preferably the first plurality of samples as well as the second plurality of samples are taken from the latest engine speed data of the monitored engine speed.

In a further example the comparison of step d) is performed when the second variable is within an engine speed interval which is provided by a first engine speed threshold and a second engine speed threshold, where the second engine speed threshold is larger than the first engine speed threshold. And where preferably if the second variable is higher than the second engine speed threshold: the fuel metering is set in the second richer setting, and where if the second variable is lower than the first engine speed threshold: the fuel metering is set in the first leaner setting.

According to one aspect of the invention the fuel metering is adjusted by means of a fuel valve, which fuel valve may e.g. be an on/off valve or a proportional valve. The fuel metering may also be adjusted by means of an air bleed valve.

If the fuel valve is an on/off valve the richer setting and the leaner setting can be effectuated by means of corresponding fuel valve control sequences determining which of the forthcoming engine revolutions the on/off valve is to be closed, during at least a portion of their corresponding intake periods, respectively open, where the leaner setting includes more closings than the richer setting. For instance the rich setting may corresponds to having the on/off valve fully opened and the leaner setting to having the on/off valve closed during the intake period of every second revolution.

BRIEF DESCRIPTION OF THE DRAWINGS

Embodiments of the invention will be described in the following in closer details by means of various embodiments thereof with reference to the accompanying drawings, where FIG. 5 is a table showing a fuel shut-off schedule for the fuel control of a crankcase scavenged engine 1.

DETAILED DESCRIPTION OF THE INVENTION

Figure 1:
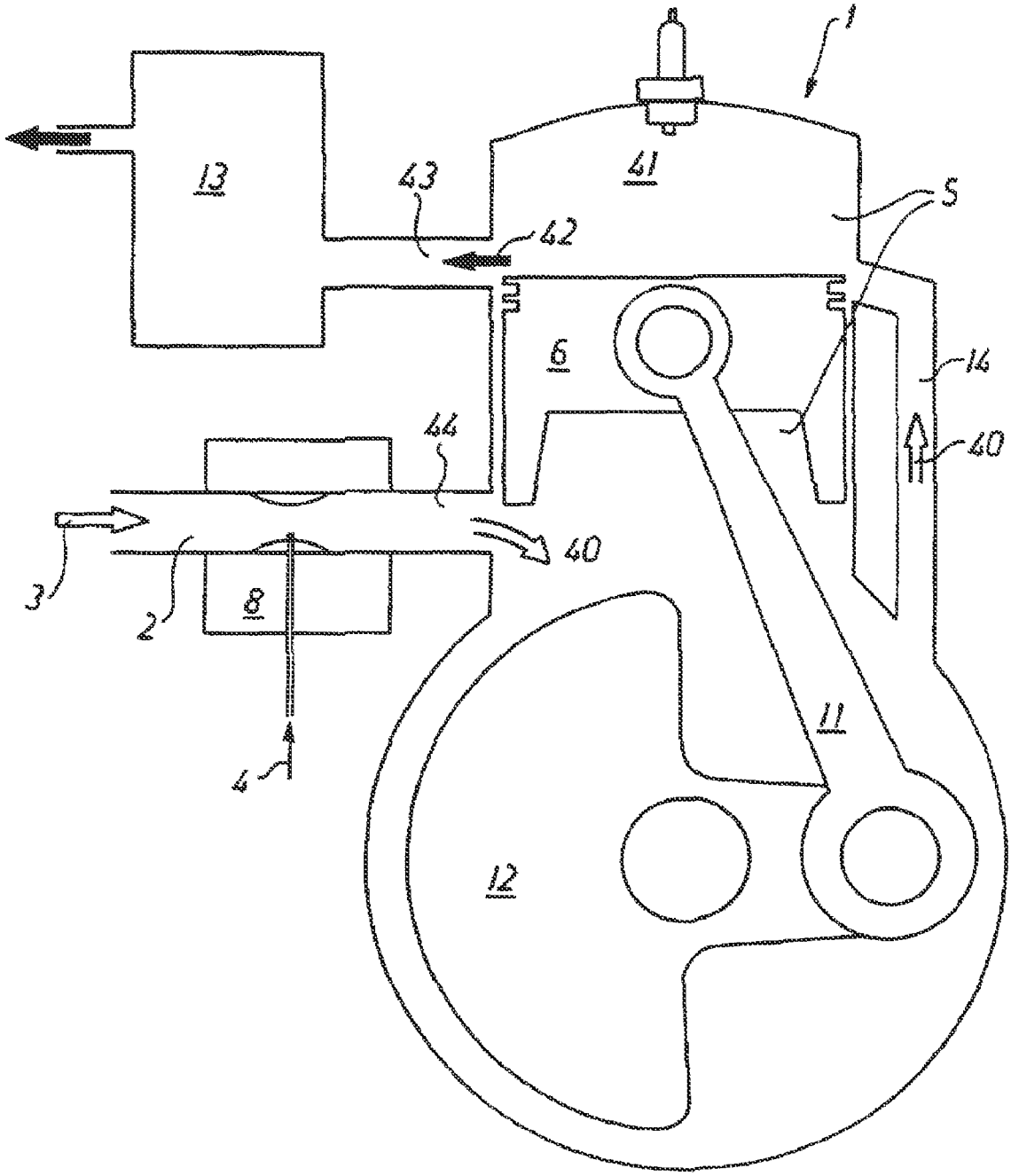
FIG. 1 is a schematically illustration of an internal combustion engine of two-stroke type in which the method according to the invention have been applied.

The invention is particularly suitable for controlling a two stroke or a four stroke crank case scavenged internal combustion engine at idle speed. The engine of FIG. 1 is known in the prior art and is incorporated in the description in order to clarify the invention. In the schematically illustrated drawing FIG. 1 numeral reference 1 designates an internal combustion engine of a two-stroke type. It is crank case scavenged, i.e. a mixture 40 of air 3 and fuel 4 from a fuel supply system 8 is drawn to the engine crank house. From the crank house, the mixture is carried through one or several scavenging passages 14 up to the engine combustion chamber 41. The chamber is provided with a spark plug igniting the compressed air-fuel mixture. Exhausts 42 exit through the exhaust port 43 and through a silencer 13. All these features are entirely conventional in an internal combustion engine and for this reason will not be described herein in any closer detail. The engine has a piston 6 which by means of a connecting rod 11 is attached to a crank portion 12 equipped with a counter weight. In this manner the crank shaft is turned around. In FIG. 1 a piston 6 assumes an intermediate position wherein flow is possible both through the intake port 44, the exhaust port 43 and through the scavenging passage 14. The mouth of the intake passage 2 into the cylinder 5 is called intake port 44. Thus the intake passage is closed by the piston 6. By opening and closing the intake passage 2 varying flow speeds and pressures are created inside the passage. These variations largely affect the amount of fuel 4 supplied when the fuel supply system 8 is of carburetor type.

Figure 2:
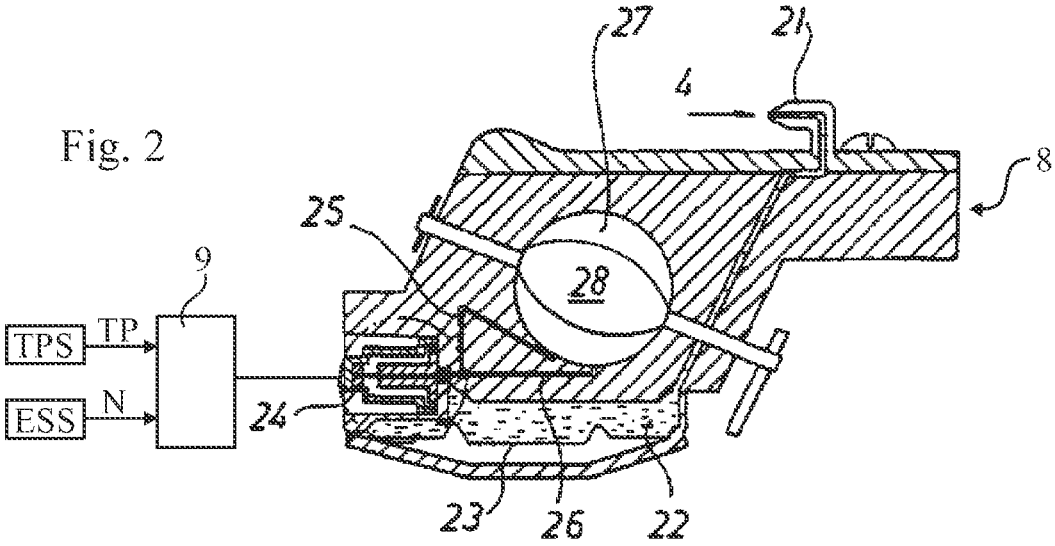
FIG. 2 illustrates schematically a carburetor of the internal combustion engine of FIG. 1.

In FIG. 2 a conventional membrane carburetor is shown but also other types of carburetors that are arranged to supply fuel in a similar manner for further treatment are possible. Supply of fuel 4 is affected to fuel nipple 21 on the carburetor. From the fuel nipple 21 fuel is carried to a fuel storage 22 which is delimited downwards by a membrane 23. The fuel storage 22 and the membrane 23 operates as a fuel pump driven by the fluctuating pressure in the venturi 27 of the carburetor. From the storage 22 a line leads to a fuel valve 24 which connects the fuel storage 22 to the fuel lines 26, 25 leading to the venturi 27 in the carburetor. The smaller channel 25 leads to the venturi 27, downstream the throttle valve 28, and is used as a so called idling nozzle whereas the coarser channel 26 also leads to the venturi 27, but upstream the throttle valve 28, and is used as the principal nozzle. Because of the underpressure, which develops in the crankcase with the upward movement of the piston 6, fuel is drawn from both the idling nozzle and the principal nozzle when the throttle valve 28 is open, whereas when the throttle valve 28 is closed fuel is drawn mainly from the idling nozzle. The fuel metering from the fuel storage 22 to the idling nozzle and principal nozzle is controlled by the fuel valve 24, thus by controlling the fuel valve 24 the fuel metering to the engine 1 can be controlled. In particular the period when the intake port 44 is open is of interest, since it is during this period the varying flow speeds and pressures inside the intake passage 2 draws air and fuel to the crank case. Thus having the fuel valve 24 closed as the intake port 44 is open, in principal only air is supplied to the crank case. And, since the crank case in crank case scavenged engines can hold a considerable amount of fuel the crank case serves as a levelling reservoir. It is therefore not necessary to adjust the fuel metering each revolution, i.e. adjusting the fuel metering in one revolution will affect subsequent revolutions. E.g. closing the fuel valve 24 every second revolution during the intake periods (i.e. when the intake port 44 is open), corresponds to having a proportional valve half open each revolution. Consequently when using an on/off valve 24 in a crank case scavenged engine the fuel metering can be controlled by a) closing/opening the on/off valve 24 every second, every third, every forth revolution and so on. It is also possible to operate the on/off valve 24 according to b) a control scheme as described in relation to FIG. 5. Further it is also possible to control the fuel metering by c) opening and closing the on/off valve 24 during a portion of the intake period, where the fuel metering is achieved by adjusting the timing of the opening and/or closing of the on/off valve 24 during the intake period, the latter may be combined the fuel metering control of a) and b).

The fuel valve 24 may be any kind of on/off valves, i.e. a valve having two positions opened and closed. However, the fuel valve 24 may also be a proportional valve. The fuel supply could also be controlled through an air bleed valve controlling an amount of air bleed into a fuel supply line to thereby adjust the amount of fuel delivered through the fuel supply line.

The fuel valve 24 is preferably controlled by a control unit 9 which receives inputs from at least one sensor. An engine speed sensor(s) ESS provides engine speed data to the engine, for instance the engine speed could be measured as the time between two following ignition sparks. Further, the control unit 9 preferably receives inputs about the position of the throttle valve from a throttle position sensor(s) TPS. The throttle position sensor(s) could for instance be a sensor that detects if a throttle trigger of a device comprising the en engine is actuated, i.e. the throttle position is not zero, or it could be a sensor that detects if the engine is fully actuated, i.e. the throttle position is full, or it could be a sensor(s) detecting both zero throttle and full throttle or a more advanced sensor(s) detecting how much the throttle trigger is actuated. Needless to say other kinds of throttle position sensor(s) may also be used. Further, the control unit 9 may of course receive inputs from other kinds of sensors than those mentioned above.

The idle speed control method described below can be implemented means of a computer program in the control unit 9. For the control unit 9 to determine if the engine is operating at idle speed, the control unit 9 may use a wide variety of criterions. Such an idle criterion may be different depending on the kind of sensor inputs available to the control unit 9. For instance having a throttle position sensor only detecting full throttle, an idle criterion could be that full throttle is not detected and that the engine speed N is below a predetermined engine speed (e.g. that an averaged engine speed is below a threshold longer than a predetermined time period). However, also other considerations besides throttle position inputs and monitored engine speed may be taken into account, for instance during a period after start of the engine, the fuel valve may be controlled according to a different method even though full throttle is not detected and the engine speed is below a threshold. Further, if the throttle position sensor is able to detect zero throttle; an idle criterion could simply be that the throttle position is zero. It should be realized that the idle speed control method described below can be used regardless of the method on how to detect that the engine is operating at idle speed, i.e. the above mentioned examples of idle criterions is not intended to limit the scope of the claims but should rather be seen as examples on how to determine if the engine is operating at idle speed.

Figure 4:
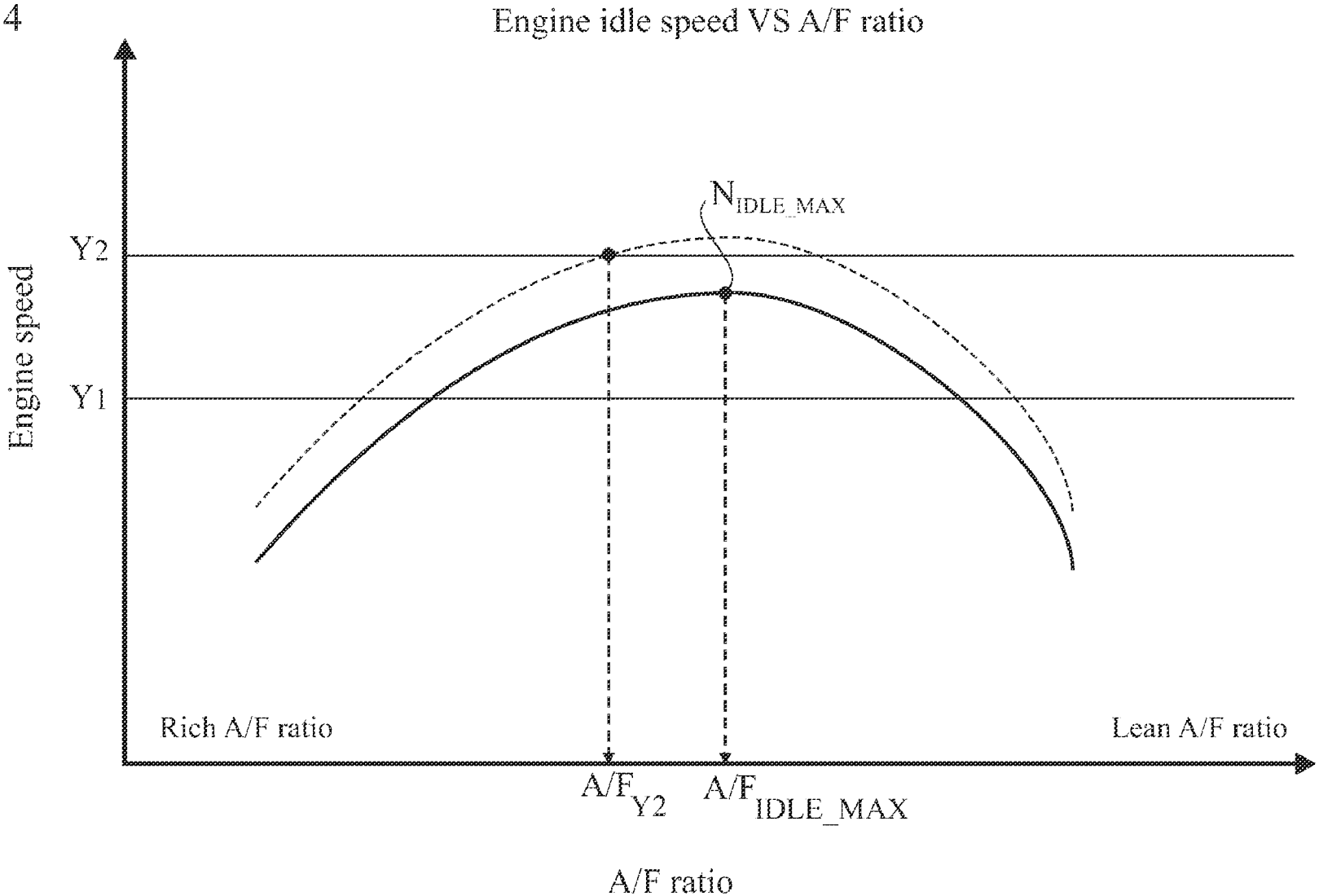
FIG. 4 illustrates how the engine idling speed varies over the A/F-ratio.

FIG. 4 illustrates in principle how the engine idling speed varies over the Air-to-Fuel ratio. The left part of the diagram shows the engine having a rich mixture, i.e. the relative amount of fuel is comparably high, and the right part of the diagram shows the engine having a lean mixture, i.e. the relative amount of fuel is comparably low. When the engine speed N has its peak $N_{IDLE_MAX}$ the corresponding air-fuel mixture $A/F_{IDLE_MAX}$ is said to be neither rich nor lean; the engine has its optimum-power position. As can be seen in the diagram the engine speed declines faster on the lean side and for that reason it is more desired to operate the engine during idle somewhat on the rich side since the engine speed will be more stable and the risk for undesired engine stops are reduced.

The idle control method which will be described below with reference to FIGS. 3 and 4 adjust the A/F-ratio towards the optimum-power position, slightly on the rich side thereof. In particular, the method is suitable for idle speed control, but could also be used in other situations, e.g. when the engine is operating at start gas or at full throttle.

Figure 3:
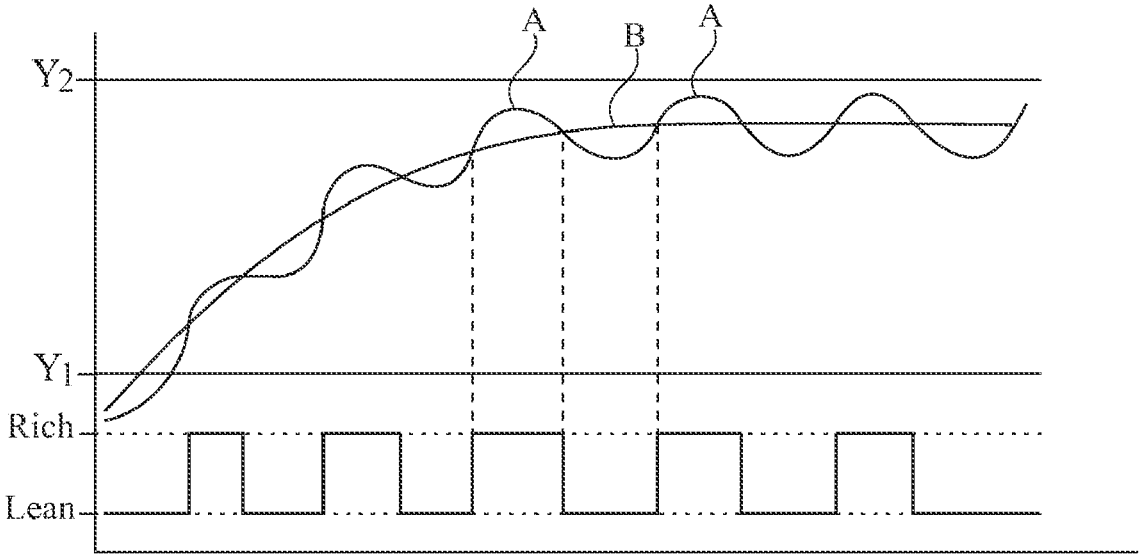
FIG. 3 illustrates the engine idle speed control method according to the invention.

The method comprises the steps of a) monitoring the engine speed regularly providing new engine speed data as the engine runs, b) determining a first variable A based on a first moving average algorithm using the monitored engine speed as input data; c) determining a second variable B based on a second moving average algorithm using the monitored engine speed as input data, where the first moving average algorithm is arranged to react faster to an engine speed change than the second moving average algorithm; and c) comparing the second variable B to the first variable A, where if 1) the second variable B is higher than the first variable A: the fuel metering is set in a first leaner setting, and where if 2) the second variable B is lower than the first variable A: the fuel metering is set in a second richer setting—thus the fuel metering will toggle between the second richer setting and the first leaner setting as long as the regulation is active as is indicated by the pulse shaped wave in FIG. 3.

In step b) and c) it is preferred that the first moving average algorithm addresses more weight to a lower number of monitored engine speeds when determining the first moving average while when determining the second moving average more weight is given to a higher number of monitored engine speeds. For instance the first variable A could be calculated through a first moving average over a first plurality of samples ×1 of the latest received engine speed data and the second variable B could be calculated through a second moving average over a second plurality of samples ×2 of the latest received engine speed data, where the second plurality of samples ×2 are more than the first plurality of samples ×1. For instance the first variable A could then be calculated as a moving average over the three last measured engine speeds and the second variable B could e.g. be a moving average over the eight last measured engine speeds, i.e. A=(n1+n2+n3)/3 and B=(n1+n2+ . . . +n8)/8, where n1 is the last measured engine speed and n2 the second last and son on.

Preferably one or both of the variables A and B are biased so that the idle speed control is active at the rich side of the diagram in FIG. 4. This can be achieved by having the second variable B biased so as to correspond to an lower averaged engine speed, for instance by subtracting the outcome from the moving average with a positive constant C1 or multiplying with factor F1 less than 1, e.g. B=(n1+n2+ . . . +n8)/8−C or B=F*(n1+n2+ . . . +n8)/8 and/or by having the first variable A biased so as to correspond to an higher averaged engine speed for instance by adding the outcome from the moving average with a positive constant C2 or multiplying with factor F2 larger than 1, e.g. A=(n1+n2+n3)/3−C2 or A=F2*(n1+n2+n3)/3. The constants C2 or C1 could be 0.5; i.e. corresponding to 0.5 rps (provided that the engine speed is measured in rps, i.e. in this example if rpm would be used C1 or C2 would be 30). The larger the bias of A or B is, the richer the corresponding A/F ratio that the idle speed control will adjust to will be, i.e. an increased bias provides for a more safe engine operation but it will also consume more fuel. Therefore according to one example the bias is larger short after start when the engine is cold and decreases when the engine has run warm.

The moving average algorithms for calculating the variables A and B could also be implemented by means of weighted moving averages, e.g. more weight could be addressed to the latest engine speed data. For instance A=(7*n1+5*n2+3*n3+n4)/16 and B=(n1+n2+n3+n4)/4−0.5, i.e. the first moving average algorithm addresses more weight to a lower number of monitored engine speeds when determining the first moving average while when determining the second moving average more weight is given to a higher number of monitored engine speeds, so that the first moving average algorithm is thereby arranged to react faster to an engine speed change than the second moving average algorithm.

Through the comparison between these two moving averages A and B the A/F ratio will tune in to an A/F ratio slightly on the rich side of the optimal A/F ratio, i.e. $A/F_{IDLE_MAX}$.

In a further embodiment the regulation using the comparison between the moving averages A and B is active when the second variable B is within an engine speed interval [y1, y2] which is provided by a first engine speed threshold y1 and a second engine speed threshold y2, where y1<y2. Whereas if the second variable B is higher than the second engine speed threshold y2: the fuel metering is set in the second richer setting to lower the engine speed, and where if the second variable B is lower than the first engine speed threshold y1: the fuel metering is set in a first leaner setting to increase the engine speed. The first threshold mainly serves to quickly adjust the fuel metering to an A/F ratio closer to the desired whereas the second threshold y2 mainly serves as an upper limit for the engine speed. Usually the upper threshold is above $N_{IDLE_MAX}$ why the upper threshold will not be passed during the idle speed control. However if for some reasons the engine speed curve is phase shifted upwards (e.g. due to the conditions of the air filter or any other reason) accordingly with the dotted lines in FIG. 4, the upper threshold will serve as an upper limit of the engine speed and preventing the A/F ratio to be leaner than $A/F_{Y2}$. In any case the engine cannot run richer than the second richer setting and not leaner than the first leaner setting, since these are the two extremes the fuel metering is toggling between.

The engine idle speed control method described above requires that the fuel metering can be set in at least two distinct states, a second richer setting and a first leaner setting. Below a number of examples on how to adjust the fuel metering will be described as well as how to set in a rich or a lean setting.

Using a proportional fuel valve 24 the richer setting could e.g. be fully (100%) opened while having the fuel valve partly open e.g. 30% open in the leaner setting. Of course, any other combination where the richer setting is a more open valve than the leaner setting is possible.

Using an on/off valve 24 the two states can be enabled by using Pulse Width Modulation as described above in relation to EP 0 799 377. E.g. one state could be enabled by having the fuel valve 24 fully opened during the entire intake period while the other state could be enabled by having the fuel valve 24 closed during a portion of the intake period or during the entire intake period.

Another way of providing different levels of the fuel metering when using an on/off valve 24 is by executing shut-offs every second, every third, or every forth engine revolution, etc., and of course having no shut-offs. E.g. a richer setting could be implemented by having the on/off valve 24 open as long as the richer setting is active, i.e. no shut-offs, and the leaner setting by closing the on/off valve 24 every second revolution as long as the leaner setting is active, in this example the fuel metering would be toggling between 0% fuel reduction and 50% fuel reduction (as compared to the maximum fuel metering).

It is also possible to use a method where a shut-off schedule, as shown in FIG. 5, determines which positions the fuel is to be shut-off during a forthcoming period of revolutions. A fuel valve control sequence $N_S$/PL, where $N_S$ is the number of fuel shut-offs during a period and PL is the period length, determines which revolutions the fuel will be shut-off during the period, by providing corresponding fuel shut-off positions FC1, . . . , FCN. The leftmost row represents the fuel valve control sequence 16/32. This means that the fuel supply is fully shut-off for 16 revolutions of the 32 revolutions in the period, i.e. a 50% fuel reduction in relation to a period utilizing the fuel valve control sequence 0/32, which has no fuel shut-offs during the period. From the left hand of the table consecutive sequences increases from the fuel valve control sequence 16/32 till the rightmost fuel valve control sequence 0/32, i.e. maximum fuel supply. Looking at the fuel valve control sequence 7/32 it can be seen that the corresponding fuel shut-offs are scheduled to be affected at the fuel shut-off positions FC1=1, FC2=6, FC3=10, FC4=15, FC5=19, FC6=24 and FC7=28. Thus the fuel supply will be shut-off at seven evenly distributed revolutions during the period and providing a fuel supply of 78% of the maximum fuel supply. Of course the fuel valve control sequence 16/32 corresponds to having the fuel valve closed every second revolution and the fuel valve control sequence 0/32 corresponds to having the fuel valve fully opened for every revolution during the period of revolutions.

An easy way to achieve evenly distributed shut-offs during a period of revolutions can be done by calculating the fuel shut-off positions as; $FCn=(n-1)*(PL-N_S)/N_S+n$, for n=1 . . . $N_S$, and rounding off the result to nearest integer. And where PL is the period length and $N_S$ is the number of shut-offs during the period. I.e. the fuel valve control sequence Ns/PL provides corresponding fuel shut-off positions [FC1, FC2, . . . , $FCN_S$]. E.g. if the period length PL for example is 64 and the fuel valve control sequence is 6/64, i.e. a 9% decrease of fuel in relation to the maximum available fuel metering, the first fuel shut-off is done at the first revolution in the period, since FC1=(1−1)*(64−6)+1=1, the second fuel shut-off is done at the period position FC2=(2−1)*(64−6)/6+2=12, the third fuel shut-off is done at period position FC3=(3−1)*(64−6)/6+3=22, the forth fuel shut-off is done at the period position FC4=(4−1)*(64−6)/6+4=33, the fifth fuel shut-off is done at the period position FC5=(5−1)*(64−6)/6+5=44 and the sixth fuel shut-off is done at the period position FC6=(6−1)*(64−6)/6+6=54. The table of FIG. 5 has been created using the above explained algorithm. Of course it should be realized that this particular algorithm is merely an example on how the shut-offs can be evenly distributed.

Using a shut-off schedule with the period length PL of 32 revolutions, a rich setting could be e.g. the fuel valve control sequence 5/32, i.e. 16% fuel reduction, and lean setting could e.g. be the fuel valve control sequence 15/32, i.e. 47% fuel reduction. Of course, any other pair of fuel valve control sequences where the richer setting provides for a lesser fuel reduction than the leaner setting is possible. Further if the idle speed control method determines that it is suitable to shift from the leaner setting to the richer setting or vice versa in the middle of a period of revolutions, the current period can be stopped and a new period using a new scheme can be started.

Figure 6:
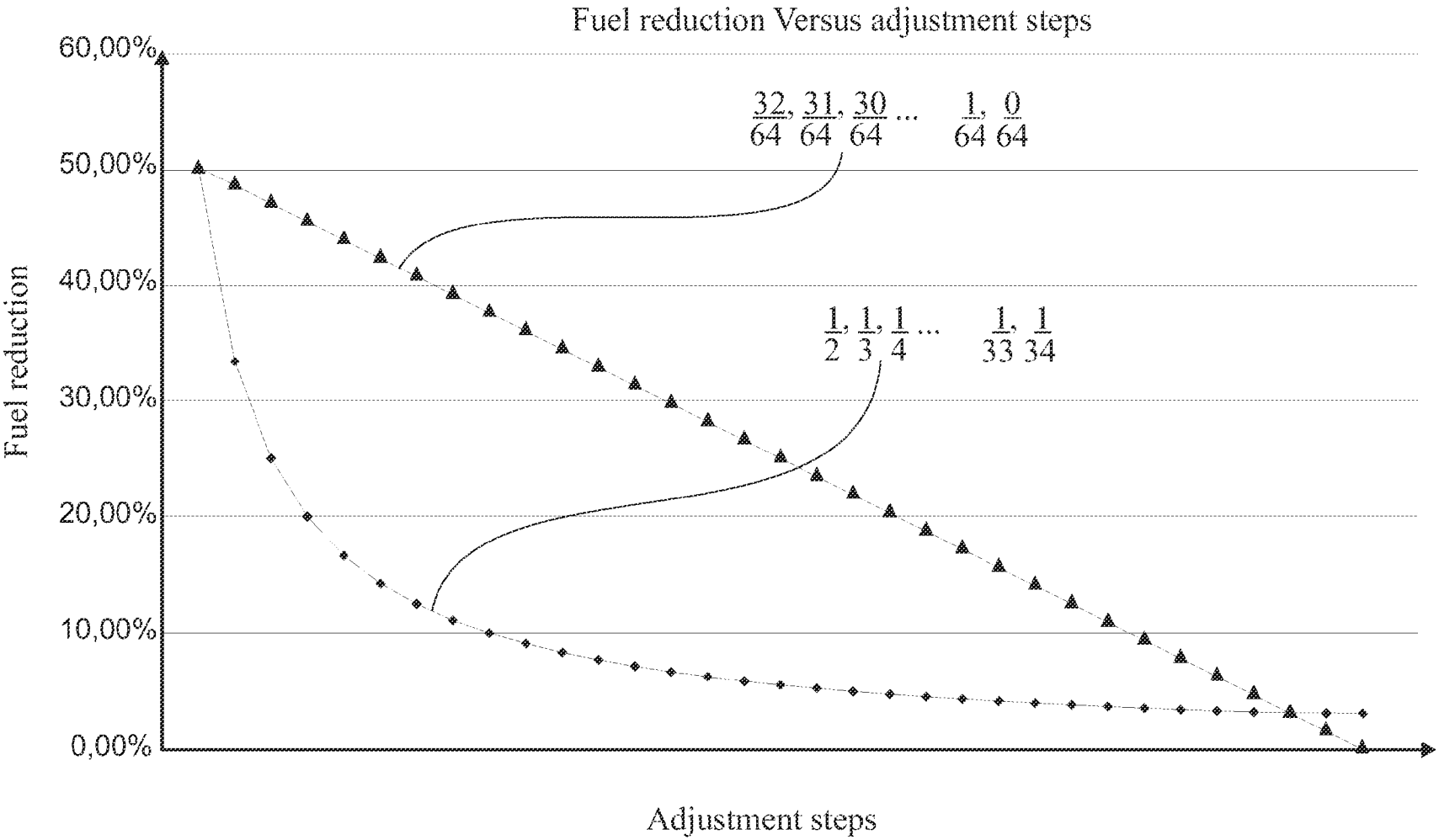
FIG. 6 is illustrates the difference by utilizing a fuel control sequences according to FIG. 5 in contrast to a more rough regulation as described in EP 0 799 377.

FIG. 6 illustrates the difference by utilizing a fuel control sequences as described in relation to FIG. 5, here however exemplified by a period length PL of 64 revolutions, i.e. 32/64, 31/64, . . . , 0/64 in contrast to shutting-off the fuel supply every second revolution, every third, every forth and so on as described in EP 0 799 377. As is evident from the figure the fuel valve control sequences 32/64, 31/64, . . . , 0/64 provides for small and evenly sized fuel reduction steps, i.e. fuel steps of 1/PL percentage units. However shutting-off the fuel supply every second revolution, every third revolution and so on; it can be seen that fuel reduction steps are far from evenly sized. The difference in fuel reduction between fuel shut-offs every second and every third revolution is as high as 17 percentages units and between fuel shut-offs at every third and every fourth revolution, the difference is still as high as 8 percentages units.

Whereas the invention has been shown and described in connection with the preferred embodiments thereof it will be understood that many modifications, substitutions, and additions may be made which are within the intended broad scope of the following claims. From the foregoing, it can be seen that the present invention accomplishes at least one of the stated objectives.

Even though the fuel supply system 8 has being described as being of carburetor type; the claimed method for controlling a fuel valve can also be suitable in a low pressure fuel injection system.

The on/off valve 24 can for instance be a solenoid valve, an electromagnetic valve, or a piezo valve.

Even though the engine have been shown with a crank case as a levelling reservoir, it would of course be possible to have other kinds of levelling reservoirs for the fuel supply. For instance in a four stroke engine, instead of using a crank case a buffer volume anywhere downstream the fuel supply system 8 and upstream the intake valve(s) of the engine could be used.

Further if n1, n2, n3, n4, n5, n6, n7, . . . are the latest measured engine speeds it would be possible to base the moving averages on a subset that to not include the absolute last measured engine speeds, e.g. the subset n3, n4, n5 could be used to calculate the first variable A.

The invention claimed is:

1. A method for controlling fuel metering in a carburetor or a low pressure injection system of an internal combustion engine when the engine is operating at idle speed, the method comprising the steps of:

a) monitoring the engine speed;

b) determining a first variable (A) based on a first moving average algorithm using the monitored engine speed as input data;

c) determining a second variable (B) based on a second moving average algorithm using the monitored engine speed as input data, where the first moving average algorithm is arranged to react faster to an engine speed change than the second moving average algorithm;

d) comparing the second variable (B) to the first variable (A), where if 1) the second variable (B) is higher than the first variable (A): the fuel metering is set in a first leaner setting, and where if 2) the second variable (B) is lower than the first variable (A): the fuel metering is set in a second richer setting.

2. The method according to claim 1, wherein the first moving average algorithm addresses more weight to a lower number of monitored engine speeds when determining the first moving average while when determining the second moving average more weight is given to a higher number of monitored engine speeds, so that the first moving average algorithm is thereby arranged to react faster to an engine speed change than the second moving average algorithm.

3. The method according to claim 1, wherein when determining the second variable (B) the outcome from the second moving average algorithm is biased to correspond to a lower averaged engine speed for instance by subtracting the outcome with a positive constant or multiplying with a factor smaller than 1.

4. The method according to claim 1, wherein when determining the first variable (A) the outcome from the first moving average algorithm is biased to correspond to a higher averaged engine speed for instance by adding the outcome with a positive constant or multiplying with a factor larger than 1.

5. The method according to claim 1, wherein the first moving average algorithm is based on a first plurality of samples (×1) of the monitored engine speed and the second moving average algorithm is based on a second plurality of samples (33 2) of the monitored engine speed, where the first plurality includes fewer samples than the second plurality.

6. The method according to claim 5, wherein the first plurality of samples (×b 1) as well as the second plurality of samples (×2) are taken from the latest engine speed data of the monitored engine speed.

7. Method according to claim 1, wherein the comparison of step d) is performed when the second variable (B) is within an engine speed interval ([y1, y2]) which is provided by a first engine speed threshold (y1) and a second engine speed threshold (y2), where the second engine speed threshold (y2) is larger than the first engine speed threshold (y1).

8. The method according to claim 7, wherein if the second variable (B) is higher than the second engine speed threshold (y2): the fuel metering is set in the second richer setting, and where if the second variable (B) is lower than the first engine speed threshold (y1): the fuel metering is set in the first leaner setting.

9. The method according to claim 1, wherein the fuel metering is adjusted by means of a fuel valve (24).

10. The method according to claim 9, wherein the fuel valve (24) is an on/off valve having two valve positions an open and a closed.

11. The method according to claim 10, wherein the second richer setting and the first leaner setting of the on/off valve is effectuated by means of a corresponding fuel valve control sequence determining which of the forthcoming engine revolutions the on/off valve (24) is to be closed respectively open, and where the leaner setting includes more forthcoming closings of the on/off valve (24) than the richer setting, and where when closing the on/off valve the closing is effectuated during at least a portion of an intake period of the corresponding revolution.

12. The method according to claim 11, wherein the richer setting corresponds to having the on/off valve fully opened and the leaner setting having the on/off valve closed during the intake period of every second revolution.

13. Method according to claim 9, wherein the fuel valve is a proportional valve.

14. Method according to claim 1 wherein the fuel metering is adjusted by means of an air bleed valve.

15. Method according to claim 1 wherein the engine is a crank case scavenged internal combustion engine.

16. Method according to claim 1 wherein the engine is a two stroke engine.

* * * * *